United States Patent [19]

Garrett

[11] 4,261,426

[45] Apr. 14, 1981

[54] REAMER STABILIZER

[75] Inventor: William R. Garrett, Houston, Tex.

[73] Assignee: Smith International, Inc., Newport Beach, Calif.

[21] Appl. No.: 35,066

[22] Filed: May 1, 1979

Related U.S. Application Data

[63] Continuation-in-part of Ser. No. 799,770, May 23, 1977, Pat. No. 4,182,425.

[51] Int. Cl.[3] ..... E21B 10/30; E21B 10/24

[52] U.S. Cl. ..... 175/228; 175/346

[58] Field of Search ..... 175/228, 342, 344–348, 175/363, 367, 368, 371, 372, 334, 335

[56] References Cited

U.S. PATENT DOCUMENTS

| | | | |
|---|---|---|---|
| 2,134,095 | 10/1938 | Abegg | 175/346 |
| 2,218,743 | 10/1940 | Catland | 175/346 |
| 2,498,756 | 2/1950 | Harris | 175/346 |
| 2,499,916 | 3/1950 | Harris | 175/346 X |
| 3,054,466 | 9/1962 | Wagnon et al. | 175/347 |
| 3,627,068 | 12/1971 | Wagnon et al. | 175/347 X |
| 3,907,048 | 9/1975 | Gray | 175/348 X |
| 4,000,783 | 1/1977 | Hug | 175/371 X |

*Primary Examiner*—Ernest R. Purser
*Assistant Examiner*—Richard E. Favreau
*Attorney, Agent, or Firm*—Murray Robinson; Ned L. Conley; David Alan Rose

[57] ABSTRACT

A roller reamer-stabilizer tool includes a tubular body having threaded pin and box connectors at each end adapted to be connected in a drill string and providing a fluid passage connecting the upper part of the drill string with the lower part. Rollers having integral pins at their ends are mounted in pockets in the sides of the body. The pins are received in stepped, arcuate cross-section bearing blocks received in correlative sockets in the body at the ends of the pockets. The blocks make an interference fit with the body. Releasing bar access passages allow a releasing bar to be inserted behind each block to drive, wedge, or pry it out. Means is provided to seal and lubricate the full lengths of the pin-block interfaces. The seals are downwardly facing to avoid entrapment of foreign material. The lubrication means includes a reservoir having a flexible wall exposed to pressure outside the tool. The roller pins are locked to the bearing blocks to enable the roller-block assemblies to be handled as unitary subassemblies used to replace worn out subassemblies of existing tools. The locking means at one end includes ball bearings to take axial thrust; at the other end the locking means is releasable to enable the block at that end to shift axially relating to the roller, to accommodate manufacturing tolerances and wear and prevent preloading of the thrust bearings.

14 Claims, 3 Drawing Figures

REAMER STABILIZER

CROSS REFERENCES TO RELATED APPLICATIONS

This application is a continuation-in-part of my prior U.S. patent application Ser. No. 799,770 filed May 23, 1977, now U.S. Pat. No. 4,182,425 issued Jan. 8, 1980 the disclosure of which is incorporated herein by reference.

Other improvements upon the construction of the aforementioned patent application are disclosed in the contemporaneously filed patent application of Glenn Allison Ser. No. 034,405, filed Apr. 30, 1979 and Glenn Allison, et al Ser. No. 034,759, filed Apr. 30, 1979, both entitled Reamer Stabilizer, to the specifications of which attention is directed for additional disclosure of reamer-stabilizers of the general type herein contemplated.

BACKGROUND OF THE INVENTION

This invention relates to roller reamer-stabilizer tools useful in the rotary system of earth boring, e.g. for petroleum wells, and more particularly to such tools in which the rollers are provided with integral pins which are rotatably mounted in bearing blocks which are replaceably mounted on the tool body. The invention is equally applicable to reamers and stabilizers, i.e. wall contacting tools, but for simplicity of example will be described with reference to reamers.

DESCRIPTION OF THE PRIOR ART.

According to the aforementioned patent application a reamer includes a tubular body having a plurality of pockets thereabout to receive the rollers, which are rotatably mounted on shafts, and the ends of the shafts are mounted in blocks having sides of arcuate configuration received in correlative sockets in the reamer body, various arrangements being provided to lubricate the roller-axle areas of relative rotation. A form of this construction similar to that shown in FIG. 9 of the aforementioned application has been built.

Certain prior patent art relative to such construction is discussed in the specification of the aforesaid prior application. Further prior art patent references are of record in the file of that application, including a United States patent to Gray, U.S. Pat. No. 3,907,048.

In the aforementioned Gray patent reamer there are no shafts rotatably supporting the roller and consequently the problems of lubricating the roller-shaft interfaces are not present. The rollers are rotatably mounted in weld integrated assemblies, each including a tray receiving the roller body and rectangular blocks rotatably receiving pins on the ends of the rollers. In such construction, due to the flat sides on the blocks, the whole blocktray-roller sub-assembly is free to move axially relative to the reamer body except as limited by the ends of the blocks abutting the reamer body, unless further securement means such as screws or weldments are employed. Due to the fixed length of the sub-assemblies, the use of screws presents difficulties arising from manufacturing tolerances. To keep the roller-tray-block sub-assemblies from falling radially into the interior of the reamer body through slots in the body's side walls, in which slots the sub-assemblies are mounted, the ends of the slots are provided with shoulders or steps in their side portions. The Gray construction, a relatively light structure, is intended for air drilling, and passages are provided for admitting air from the reamer body to the areas between pins at the ends of the rollers and the blocks and between the tray and rollers.

Other constructions employing rollers with gudgeons or pins at their ends are disclosed in U.S. Pat. No. 3,820,613 to White. See also the brochure of Technical Drilling Tools, Inc. believed to make such a reamer.

SUMMARY OF THE INVENTION

According to the present invention, there is provided a roller reamer capable of use with high pressure liquid drilling fluid. The reamer body is a continuous tube having a plurality of pockets in its side walls, as in the aforementioned Garrett patent application. Arcuate side wall sockets at each end of each pocket receive correlatively shaped mounting blocks, with an interference fit, and release bar access passages in the sides of the reamer body allow a wedge or other tool to be inserted from outside the reamer body under each block between the block and the part of the reamer body behind or under the block, thereby to enable the blocks to be driven, wedged or pried out. The foregoing is all in accordance with the aforementioned prior application.

Further, in accordance with the present invention, each roller is provided at each end with an integral pin which is rotatably mounted in one of the blocks. Means is provided to seal and lubricate the full lengths of the pin-block interfaces. The seals are downwardly facing to avoid entrapment of foreign material. The lubrication means includes a reservior having a flexible wall exposed to pressure outside the tool. The roller pins are locked to the bearing blocks to enable the roller-block assemblies to be handled as unitary sub-assemblies used to replace worn out sub-assemblies of existing tools. The locking means at one end includes ball bearings to take axial thrust; at the other end the locking means is releasable to enable the block at that end to shift axially relative to the roller, to accommodate manufacturing tolerances and wear and prevent preloading of the thrust bearings.

BRIEF DESCRIPTION OF THE DRAWINGS

For a detailed description of a preferred embodiment of the invention, reference will now be made to the accompanying scale drawings wherein.

The drawings employ the conventions of the United States Patent & Trademark Office for patent cases relative to the identification of materials from which it will be seen that substantially the entire reamer is made of metal. Preferably, all parts are made of steel, except that the earth formation reducing means comprising the inserted teeth in the reamer rollers is preferably made of tungsten carbide, the O-ring seals are made of an elastomer, the flexible boot retaining washer is preferably made of plastics material, and the boot may be made of an elastomer or plastics material, for example.

DESCRIPTION OF PREFERRED EMBODIMENT

Figure 1:
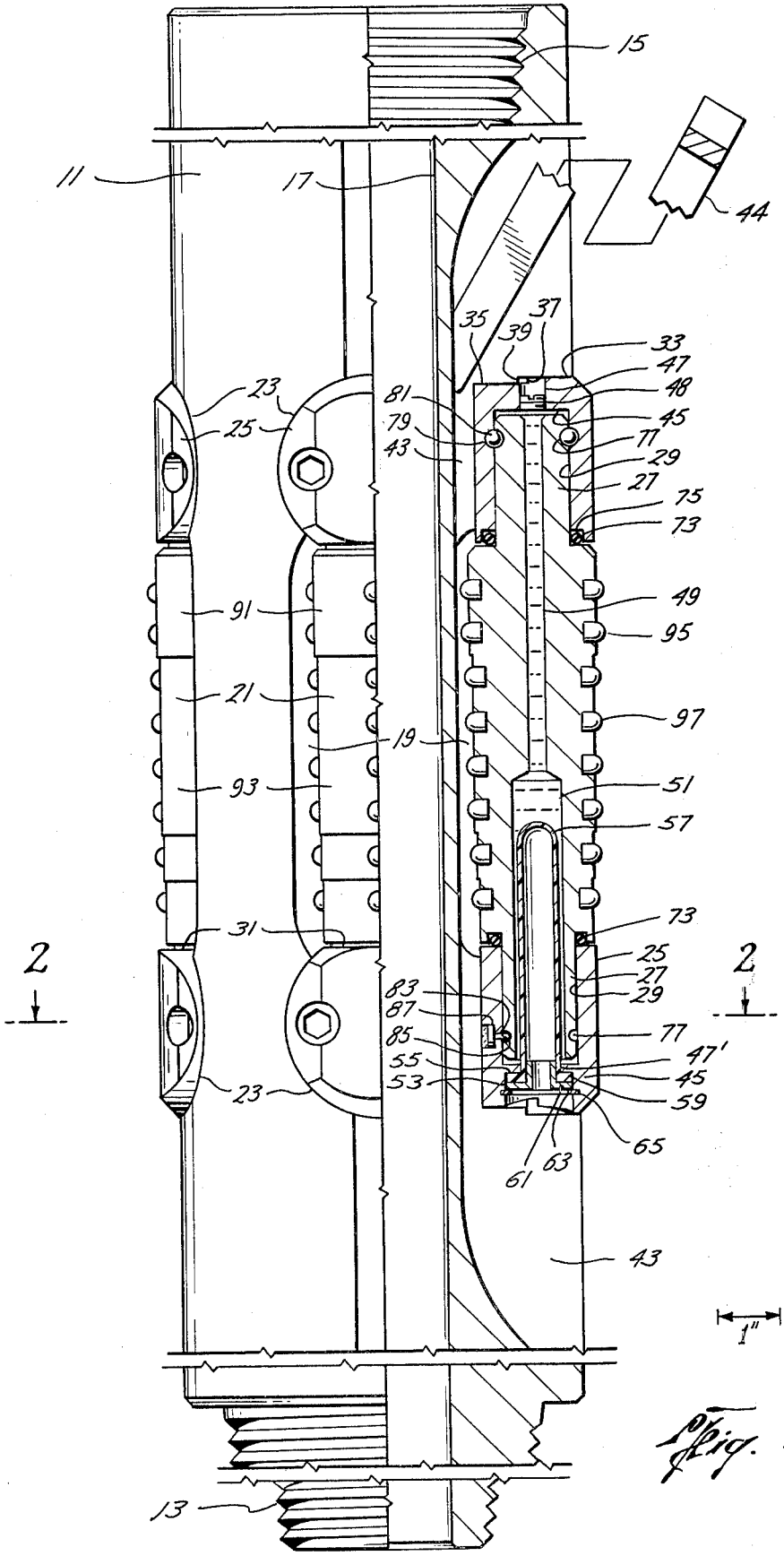
FIG. 1 is a half section showing a reamer embodying the invention.

Referring now to FIG. 1, there is shown a reamer including a tubular body 11 having tool joint type pin and box threaded connectors 13, 15 at its ends, as might be suitable for a reamer used in the drill string some distance about the drill bit. Other forms of threaded connectors, e.g. a box on bottom and a pin or box on top, for use immediately about a drill bit, or other combinations, with a pin or box at either end, may be employed as required for connection to adjacent drill string members. There is thus provided an impervious fluid passage 17 through the reamer from the connector 15 at the upper end to the connector 13 at the lower end.

Figure 2:
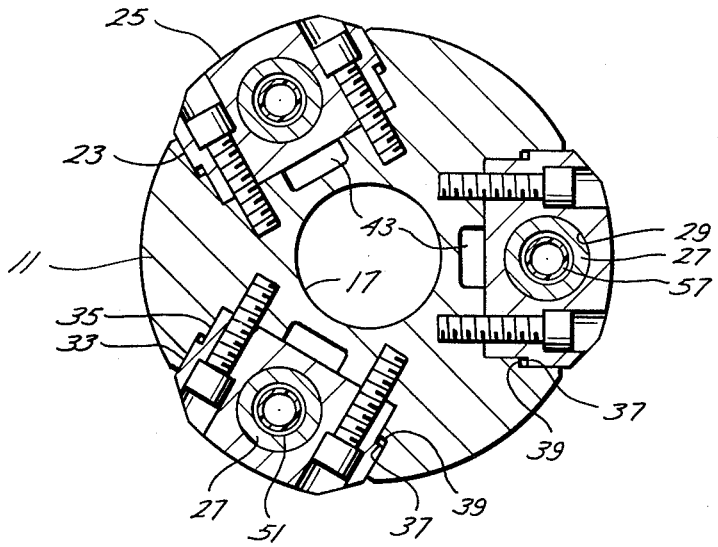
FIG. 2 is a section taken at plane 2—2 of FIG. 1.

Around the outer periphery of the reamer body is a plurality of pockets 19, each adapted to receive one of the rollers 21. FIG. 1 shows the roller pockets as though there were four of them disposed at ninety degrees to each other, thereby to facilitate showing both a straight front view and a sectional view, but preferably there are three pockets disposed 120 degrees apart, as shown in FIG. 2.

At each end of each pocket is a socket 23 within which is received, with an interference fit, a bearing block 25. Each roller 21 has a cylindrical pin 27 at each end rotatably received in a cylindrical bore or hole 29 in one of the bearing blocks.

As described in the aforementioned Garrett patent application, sockets 23 have side walls of cylindrically arcuate figuration. Bearing blocks 25 have cylindrically arcuate side wall portions correlative to the arcuate side walls of the sockets. Portions 31 of the block side walls adjacent the ends of the rollers are plane or flat.

The arcuate side wall portions of the blocks each include a larger diameter outer part 33 and a smaller diameter inner part 35 with an arcuate step 37 therebetween. Similarly, sockets 23 have arcuate steps at 39 between parts of larger outer and smaller inner diameter. The socket steps 39 are closer to the reamer axis than the block steps 37 to insure that the blocks bottom in the sockets. The stepped construction facilitates quick release when it is desired to remove the blocks.

As in the construction disclosed in the aforementioned Garrett patent application, the bearing blocks are provided with cap screws to serve as safety retention means, the screws passing through counter sunk holes in the blocks into threaded holes in the reamer body. When it is desired to replace a roller, the screws are removed. The reamer body is provided with slots 43 which extend underneath the radially inward parts of the bearing blocks so that a releasing bar 44 can be inserted therebehind to drive, wedge or pry out the blocks. This is more fully described in the aforementioned Garrett patent application.

Bores 29 in blocks 25 have closed ends 45. Through the end of each upper block extends a port 47. Ports 47 are closed by screw plugs 48. Through the end of each lower block extends a port 47'. Ports 47, 47' are coaxial with an axial bore 49 extending from the pin at the upper end of each roller down through the upper part of each roller to a coaxial counterbore 51. Each counterbore 51 extends through the lower end of the respective roller and the pin at the lower end of the roller to a point opposite port 47' in lower block 25. Each port 47' widens out into a socket 53 at the lower end of the block, forming an annular shoulder 55 at the juncture of the socket and counterbore.

Within each counterbore 51 is a flexible elastomeric (rubber) sack or boot 57. The boot has an outturned lip 59 at its mouth, the lip resting against shoulder 55. A metal or plastics material ferrule 61 rests against the lip and is held in place by a resilient spring ring 63. Ring 63 is received in an annular groove 65 in socket 53. The interior of boot 57 is exposed to drilling fluid pressure through its mouth, ferrule 61, ring 63, and the mouth of socket 53 in block 25, the latter opening into slot 43 in the exterior of the reamer body.

Bore 49 and counterbore 51 are filled with lubricant such as grease. The grease is delivered to the outer periphery of each pin 27 by passing out the end of the pin through the bore or counterbore and around the end of the pin inside the closed end of the hole on the bearing block and back along the outside of the pin.

The grease is retained in each of the bearing areas by an O ring seal 73 between the root of the pin 27 and the mouth of the bore 29 in the bearing block and the adjacent end of the bearing block. The O ring at the upper end of each roller is received in an annular rabbet 75 in the inner periphery of the mouth of the adjacent block. The O ring at the lower end of each roller is received in an annular groove in the lower end of the roller adjacent the root of the pin. Since each O ring seals between horizontal surfaces, i.e., the end of a roller and an adjacent block, there is no pocket to accumulate dirt adjacent the O ring.

To retain the bearing blocks assembled with the roller pins so that the O ring seals are effective, each pin 27 is provided with an annular groove 77. A companion annular groove 79 in each upper block 25 forms with the adjacent pin groove 77 a race for locking balls 81. Balls 81 also provide ball bearings to take the end thrust on each roller.

In each lower block 25 is provided a radial port 83 receiving a retaining pin 85 whose head lies against a shoulder formed by a counterbore 87 at the outer end of port 83. The inner tip of pin 85 is a hemisphere making a loose fit in the adjacent pin groove 77, to allow such relative motion of pin and block as may be required because of manufacturing variations in the distance between the upper and lower blocks. Each retaining pin may be welded in place.

Grease is initially introduced into each bore 49 and counterbore 51 through port 47 in the uppermost block 25 and the port is then closed with screw plug 48. When the reamer is in use, as grease is consumed at the bearing area between each roller pin and bearing block bore, due to heat and pressure, additional grease is delivered to the bearing area from the interior of the adjacent roller due to drilling fluid pressure expanding the boot.

In the illustrated embodiment of the reamer, the rollers have larger and smaller diameter cylindrical lands 91, 93 in which are set circumferential rows of tungsten carbide teeth 95, 97, the teeth 95 protruding farther radially than the teeth 97. Other forms of bore hole wall contacting, earth formation reducing means besides teeth 95, 97 could be employed, as more fully described in the aforementioned prior Garrett application.

In operation, the reamer is connected in a drill string at a desired level, and as the drill string is rotated in the well bore the reamer rollers cut the earth formation to maintain the hole fall gage. The rollers also help keep the drill bit and other parts of the drill string central so as to keep the hole straight.

As the drill string and reamer body rotate in the hole, the rollers, contacting the sides of the well bore, rotate about their own axes, the pins at the end of the rollers turning in the bearing blocks, which take the lateral thrust. As the drill string moves and turns and the rollers rotate, the uppermost roller pins may also exert end thrust on ball bearings 81, due to the weight of the rollers forcing the rollers down, or due to the sides of an undergage hole causing the rollers to be held up as the drill string descends. Since the pins are not free to move axially in the bearing blocks, the rollers cannot shift axially and the clearance between the pin at each end of each roller and the end of the adjacent bearing block is maintained so that grease can flow therethrough; also, the O rings 73 are maintained in sealing engagement with the ends of the rollers and the bearing blocks.

As drilling proceeds, drilling fluid is pumped down the drill string and through fluid passage 17 from the upper end of the reamer body down to the lower end of the body, and then after passing through the drill bit the drilling fluid returns back up the well bore outside the drill string. As the rising drilling fluid goes upwardly past the outside of the reamer body, it also passes through the pockets in the reamer body and cleans out the detritus from the pockets. It also pressurizes the insides of the boots to force grease from the rollers to lubricate and cool the surfaces of the interfaces of the roller pins and bearing blocks.

Figure 3:
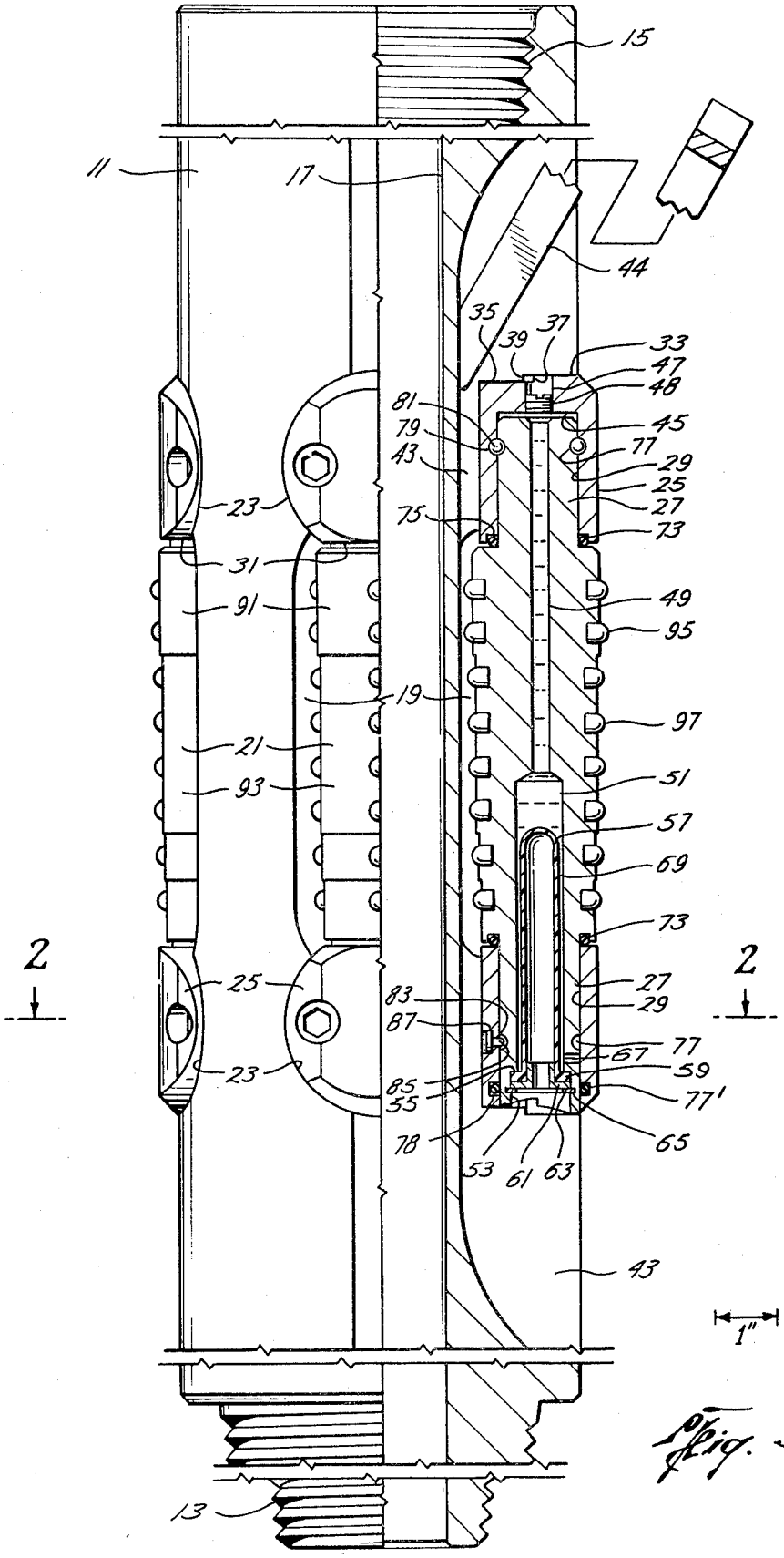
FIG. 3 is a view similar to FIG. 1 showing a modification.

Referring now to FIG. 3, there is shown a modification of the previously described construction. Except as shown in FIG. 3 the modified construction is the same as that previously described and like parts bear like numbers so that the description need not be repeated.

The modification in FIG. 3, as compared to the FIG. 1 construction, is all at the lower end of each roller pin and the associated bearing block. In the FIG. 1 construction, in which each boot lip is sealed to the associated lower bearing block, the roller rotates relative to the boot. In the case of a stiff grease being employed as a lubricant, there may be considerable torque imposed on each boot. To overcome this possible problem, in the FIG. 3 modification the lip of the boot is sealed to a socket in the end of the adjacent roller pin.

Referring to FIG. 3, bore 29 in each lower block extends clear through the block. Each counterbore 51 at its lower end expands into a socket 53 at the lower end of the pin, forming an annular shoulder 55 at the juncture of the socket and counterbore. The outturned lip 59 of each boot 57 rests against shoulder 55 of the respective counterbore. A metal or plastics material ferrule 61 rests against the lip, the tubule of the ferrule extending into the mouth of the boot and holding it open. Ferrule 61 is held in place by a resilient spring ring 63. Ring 63 is received in an annular groove 65 in socket 53. The interior of boot 57 is exposed to drilling fluid pressures through its mouth, ferrule 61, ring 63, the mouth of socket 53, and the end bore 29 in bearing block 25, the latter opening into slot 43 in the exterior of the reamer body.

As in the FIG. 1 embodiment, bore 49 and counterbore 51 are filled with a lubricant such as grease. The grease is delivered to the outer periphery of each upper pin 27 as in the FIG. 1 embodiment by passing out the end of the pin through the bore or counterbore and around the end of the pin inside the closed end of the hole in the associated bearing block and back along the outside of the pin. In contract, grease is delivered to the outer periphery of each lower pin 27 by passing from counterbore 51 through a radial port 67 in the pin. As in the FIG. 1 embodiment, counterbore 51 is enough larger in diameter than boot 57 to leave an annular clearance 69 through which grease can flow, in this case to radial port 67 rather than out the end of the pin as in FIG. 1.

As in the FIG. 1 embodiment the grease is retained in each of the bearing areas by an O ring seal 73 between the root of the pin 27 and the mouth of the bore 29 and the adjacent end of the roller. However, because in the FIG. 3 construction the mouth of each boot is sealed to the adjacent lower pin rather than to the adjacent lower block, and the bore 29 in each lower block goes clear through the block, there is provided at the lower end of each roller an additional O ring seal 77' received in an annular groove 78 in each lower block 29, sealing between each lower pin 27 and the bore 29 in the adjacent lower block 25.

Except as noted above, the construction and operation of the FIG. 3 embodiment are the same as that of the FIG. 1 embodiment.

While preferred embodiments of the invention have been shown and described, modification thereof can be made by one skilled in the art without departing from the spirit of the invention.

I claim:

1. In apparatus useful in earth boring by the rotary method, comprising:

a tubular body, thread means at each end of the body for making a rotary shouldered connection with an adjacent drill string member, a plurality of circumferentially spaced, axially elongated pockets in the sides of the body, a plurality of rollers, each disposed in one of said pockets, each end of each roller being generally flat, a plurality of sockets in the sides of the body positioned one at each end of each pocket, a plurality of blocks disposed one in each socket, each block being provided with an opening, an integral pin at each end of each roller, each of said pins being rotatably mounted in the one of said openings in the adjacent one of said blocks, the improvement according to which each of said sockets has arcuate side walls, each of said blocks having an arcuate side wall portion generally correlative to the side walls of said sockets and making an interference fit therewith, and tool cooperation means carried by the apparatus for cooperation with a tool for forcing out the blocks when it is desired to replace the rollers, said tool cooperation means comprising tool passage means each providing an opening extending from the outer surface of said body between a socket and the nearest end of the body to behind the bottom of the socket.

2. Apparatus according to claim 1, each block having a front facing radially outwardly of said body and a back facing radially inwardly, the arcuate side wall of each of said sockets being stepped, forming an arcuate step, each arcuate step facing outwardly toward the outer periphery of the body, the arcuate side wall portion of each block being stepped providing an arcuate step, the arcuate step of the side wall of each block facing inwardly toward the interior of the block, each arcuately stepped socket being adapted to receive one of said blocks by a motion of the block in a direction from outside the body going toward the interior thereof, each of said blocks each having a flat side wall portion adjacent to the flat end of the adjacent roller.

3. Apparatus according to claim 1, the pin at one end of each roller having an annular groove therearound and said hole in the adjacent block having an annular groove thereabout in register with said groove around the pin and which with the annular groove around the adjacent pin forms a race for ball hearings, ball bearings in each said race providing with the race thrust bearing means to take axial thrust on the respective roller and hold it against axial motion relative to the blocks.

4. Apparatus according to claim 3, the pin at the other end of each roller having an annular groove therearound and each adjacent block having a retaining pin in register with the last said annular groove extending into the groove to limit relative axial movement of the block and pin.

5. Apparatus according to each of claims 1, 2, 3, or 4 including seal means sealing off a portion of the interface between each pin and the opening in the block in which the pin is received, grease reservoir means in each roller, and means communicating the reservoir means in each roller with said portions of said interface at the ends of the respective roller.

6. Apparatus useful in earth boring by the rotary method, comprising:

a tubular body, thread means at each end of the body for making a rotary shouldered connection with an adjacent drill string member, a plurality of circumferentially spaced, axially elongated pockets in the sides of the body, a plurality of rollers, each disposed in one of said pockets, a plurality of sockets in the sides of the body positioned one at each end of each pocket, a plurality of blocks disposed and releasably retained one in each socket, each block being provided with an opening to receive a pin extending from one end of the adjacent roller, an integral pin at each end of each roller, each pin being rotatably disposed in one of said openings in said blocks, seal means sealing off a portion of the interface between each pin and the opening in the block in which the pin is received, grease reservoir means in each roller, passage means communicating the reservoir means in each roller with said portions of said interface at the ends of the respective roller, and thrust bearing means between a pin on, each said roller and the adjacent block to take axial thrust, the end of each pin being spaced from all other parts of the apparatus, the ends of each roller being spaced from the adjacent blocks.

7. Apparatus according to claim 6, each grease reservoir including bore means extending the length of each roller and the pins at the ends thereof, each said bore means being open at each end for the flow of grease therefrom across the end of the pin to the adjacent pin-block opening interface.

8. Apparatus according to claim 7, each said bore means including a bore extending axially from the pin at one end of each roller and a counterbore of large diameter than said bore extending axially from the end of the pin at the other end of the roller and joining the bore, a wall at the end of the block opening adjacent the end of each of the last said pins, a socket in each of the last said pins in register with said counterbore, said grease reservoir means in each roller further including a flexible sack disposed with its closed end in said counterbore and its mouth secured in said socket in the pin and sealed thereto.

9. Apparatus according to claim 6, each of said seal means including an O-ring between the root of the pin and the mouth of the opening in the adjacent block and the end of the adjacent roller.

10. Apparatus according to claim 9, the O-ring at one end of each roller being disposed in an annular rabbet in the inner periphery of the mouth of the block opening, the O-ring at the other end of each roller being disposed in an annular groove in the adjacent end of the roller around the root of the pin at that end.

11. Apparatus according to claim 10, the seal means in the block at each end of each roller further including an imperforate wall closing one end of the opening of the block, the grease passage means at each end of each roller including the space between the end of the pin and said wall in the block.

12. Apparatus according to claim 9, the seal means in the block at one end of each roller further including an imperforate wall closing one end of the opening of the block, the grease passage means at that end of each roller including the space between the end of the pin and said wall in the block.

13: Apparatus according to claim 12, the seal means in the block at the other end of each roller further including an imperforate wall closing one end of the opening in the block, the grease passage means at the other end of each roller including the space between the end of the pin and the last said wall in the block.

14. Apparatus according in claim 12, the seal means in the block at the other end of each roller further including a second O-ring between the pin and the opening in the block, said second O-ring being nearer the end of the pin than the first mentioned O-ring, each grease reservoir means including a bore extending axially from the pin at one end of each roller and a counterbore of larger diameter than said bore extending axially from near the end of the pin at the other end of the roller and joining the bore, and a socket in the end of the last said pin joining said counterbore, said grease reservoir means in each roller further including a flexible sack disposed with its closed end in said counterbore and its mouth secured in said socket and sealed thereto, each said sack being tubular and having an outer diameter smaller than the inner diameter of said counterbore providing an annular clearance volume between the sack and counterbore through which grease can flow; and a radial port in each block adjacent a counterbore communicating the interface between the block opening and pin therein with said annular clearance.

* * * * *

UNITED STATES PATENT AND TRADEMARK OFFICE

CERTIFICATE OF CORRECTION

PATENT NO. : 4,261,426

DATED : 4-14-81

INVENTOR(S) : William R. Garrett

It is certified that error appears in the above—identified patent and that said Letters Patent is hereby corrected as shown below:

Column 4, line 55: after "Garrett insert -patent-.

Column 5, line 60: change "contract" to -contrast-.

Column 7, line 20, Claim 5, 1st line: change "to each of claims" to -to claim-.

Signed and Sealed this

*Fourth* Day of *August 1981*

[SEAL]

*Attest:*

GERALD J. MOSSINGHOFF

*Attesting Officer*

*Commissioner of Patents and Trademarks*